US011677166B2

(12) United States Patent
Miedl et al.

(10) Patent No.: US 11,677,166 B2
(45) Date of Patent: Jun. 13, 2023

(54) OUTER CONDUCTOR ELEMENT, PLUG CONNECTOR ARRANGEMENT AND ASSEMBLY METHOD FOR A PLUG CONNECTOR ARRANGEMENT

(71) Applicant: Rosenberger Hochfrequenztechnik GmbH & Co. KG, Fridolfing (DE)

(72) Inventors: Thomas Miedl, Tittmoning (DE); Walter Baldauf, Fridolfing (DE); Marcel Volkmar, Breitungen (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 41 days.

(21) Appl. No.: 17/239,975

(22) Filed: Apr. 26, 2021

(65) Prior Publication Data

US 2021/0344125 A1 Nov. 4, 2021

(30) Foreign Application Priority Data

Apr. 30, 2020 (EP) ..... 20172513

(51) Int. Cl.
*H01R 4/18* (2006.01)
*H01R 43/16* (2006.01)

(52) U.S. Cl.
CPC ..... *H01R 4/185* (2013.01); *H01R 43/16* (2013.01)

(58) Field of Classification Search
CPC ..... H01R 4/185; H01R 43/16
USPC ..... 439/865
See application file for complete search history.

(56) References Cited

U.S. PATENT DOCUMENTS 5,429,529 A * 7/1995 Hashizawa ..... H01R 9/0518 439/98
5,542,861 A * 8/1996 Anhalt ..... H01R 9/0518 439/585
6,200,162 B1 * 3/2001 Aoyama ..... H01R 4/184 439/585
6,210,223 B1 * 4/2001 Aoyama ..... H01R 13/6593 439/585

(Continued)

FOREIGN PATENT DOCUMENTS

EP 0986135 A1 3/2000
EP 3396791 A1 * 10/2018 ..... H01R 13/18

(Continued)

OTHER PUBLICATIONS

European Search Report dated Sep. 29, 2020.

*Primary Examiner* — Peter G Leigh
(74) *Attorney, Agent, or Firm* — Randall Danskin P.S.

(57) ABSTRACT

An outer conductor contact element for a plug connector arrangement, having a fixing stop which engages behind a cable-side end face of a support sleeve and along a longitudinal axis (L) of the plug connector arrangement, and the cable-side end face is remote from a front, free end of the outer conductor contact element, and the fixing stop is formed in the outer conductor contact element by a male connector-side edge of a material cut-out in the outer conductor contact element that is proximate to a front, free end of the outer conductor contact element. Alternatively, or in addition, the fixing stop is formed by a separate stop element that is fastened to an inner wall of the outer conductor contact element. Alternatively, or in addition, the fixing stop is formed by a stamped shaping in the outer conductor contact element.

19 Claims, 10 Drawing Sheets

(56) References Cited

U.S. PATENT DOCUMENTS

| | | | | |
|---|---|---|---|---|
| 6,257,931 | B1 * | 7/2001 | Sakurai | H01R 9/0518 439/394 |
| 6,384,335 | B1 * | 5/2002 | Saito | H01R 9/0518 439/585 |
| 6,533,609 | B2 * | 3/2003 | Koide | H01R 9/0518 439/585 |
| 7,044,756 | B1 * | 5/2006 | Asakura | H01R 13/648 439/607.41 |
| 7,368,664 | B2 * | 5/2008 | Asakura | H01R 9/0512 439/607.41 |
| 7,980,894 | B1 * | 7/2011 | Hall | H01R 24/40 439/585 |
| 8,079,870 | B2 * | 12/2011 | Nakamura | H01R 9/0518 439/585 |
| 8,366,483 | B2 * | 2/2013 | Hardy | H01R 9/0518 439/585 |
| 8,602,797 | B2 * | 12/2013 | Omae | H01R 13/6592 439/99 |
| 9,673,578 | B1 * | 6/2017 | Lane | H01R 13/631 |
| 9,787,017 | B1 * | 10/2017 | Lane | H01R 9/0518 |
| 9,941,608 | B2 * | 4/2018 | Zebhauser | H01R 9/0524 |
| 10,074,462 | B2 | 9/2018 | Brueckner | |
| 10,446,951 | B2 | 10/2019 | Miedl | |
| 10,594,057 | B2 * | 3/2020 | Kanemura | H01R 43/16 |
| 2013/0224997 | A1 * | 8/2013 | Miyawaki | H01R 9/05 439/585 |
| 2019/0020128 | A1 * | 1/2019 | Miedl | H01R 4/183 |

FOREIGN PATENT DOCUMENTS

| | | | | | |
|---|---|---|---|---|---|
| EP | 3242359 | B1 * | 7/2019 | | H01B 11/00 |
| JP | 2002208461 | A * | 7/2002 | | |
| JP | 2005093173 | A * | 4/2005 | | H01R 9/0518 |
| JP | 2010003588 | A * | 1/2010 | | |
| WO | WO-9310578 | A1 * | 5/1993 | | H01R 9/0518 |
| WO | WO-2015182500 | A1 * | 12/2015 | | H01R 24/56 |
| WO | WO-2018197641 | A1 * | 11/2018 | | H01R 13/11 |

* cited by examiner

OUTER CONDUCTOR ELEMENT, PLUG CONNECTOR ARRANGEMENT AND ASSEMBLY METHOD FOR A PLUG CONNECTOR ARRANGEMENT

CROSS REFERENCE TO RELATED APPLICATIONS

This US Utility Patent Application is a National Stage application of European Patent Application No. 20 172 513.2 which was filed on 30 Apr. 2020 and titled "Outer Connector Element, Plug Connector Arrangement and Assembly Method for a Plug Connector Arrangement". The aforementioned European Patent Application No. 20 172 513.2 is hereby expressly incorporated herein by this reference in its entirety.

BACKGROUND AND SUMMARY

The invention relates to an outer conductor contact element for a plug connector arrangement, comprising at least one fixing stop that is able to engage behind a cable-side end face of a support sleeve.

Moreover, the invention relates to a plug connector arrangement, comprising a support sleeve and an outer conductor contact element.

Furthermore, the invention relates to an assembly method for a plug connector arrangement, according to which an outer conductor contact element is assembled on a support sleeve in such a manner that a fixing stop of the outer conductor contact element engages behind a cable-side end face of the support sleeve.

A number of electrical plug connectors are known in the electronics industry. Electrical plug connectors are used, as is known, so as to transmit electrical-supply signals and/or data signals to corresponding mating plug connectors. A plug connector, or a mating plug connector, can be a male connector, a mounting plug, socket, a coupling or an adaptor. The term "plug connector" or "mating plug connector" used within the scope of the invention is representative for all variants.

High demands with regard to robustness and safety and reliability of the plug connector are placed in particular on plug connectors for the automotive industry or for vehicles. Thus, a plug connector must sometimes be able to withstand high loads for example mechanical loads. It is a priority to ensure safety and reliability particularly in the case of an autonomous operation of vehicles and for driver assist systems.

It is sometimes necessary during the autonomous operation of a vehicle, or during the use of assist systems, to combine with one another and transport, usually in real time, high volumes of data from multiple cameras, various sensors and navigation sources. Accordingly, an efficient infrastructure in the vehicle electronic system is required for the operation of many devices, screens and cameras. Furthermore, the demands placed on plug connectors and cable connections within a vehicle with regard to the required data rate are meanwhile very high. At the same time, it is important in order to save installation space and weight to embody the plug connectors in an as compact as possible manner.

In order to assemble a plug connector on a cable, it is known to press the cable and the plug connector together in a connecting region. In this case, the force with which the plug connector is pressed on influences the mechanical holding force between the cable and the plug connector.

However, a pressing-on procedure is naturally associated with a corresponding deformation of the cable and/or of the plug connector components. This deformation can eventually have an adverse effect on the electrical properties of the plug connector arrangement. Consequently, it is generally necessary to accept a compromise between sufficient holding force and good electrical properties. Such a compromise can counteract, in particular, the suitability particularly of the robust plug connector arrangement for use in high frequency technology.

In order to improve this state, the generic DE 10 2017 006 767 A1 proposes a plug connector arrangement having a plug connector and a cable, wherein a support sleeve is fastened to a section of the cable, said section being stripped of a cable sheath. An indentation is embodied between a cable-side edge of the support sleeve and the stripped edge of the cable sheath that remains on the cable. Finally, in order to assemble the plug connector, its outer conductor contact element is pressed onto the cable and support sleeve in such a manner that the outer conductor contact element moves into the indentation between the support sleeve and the cable sheath. Consequently, in addition to providing a non-positive locking connection, it is possible to provide a positive-locking connection along the longitudinal axis of the plug connector arrangement. The plug connector arrangement can thus have an increased holding force whilst maintaining good electrical properties.

However, in practice it has been shown that the fastening principle, proposed in DE 10 2017 006 767 A1 requires the support sleeve to have a given minimum wall thickness in order to be able to be used in a reliable manner. By virtue of the fact that the support sleeve together with the cable sheath forms the indentation of the cable, the wall thickness of the support sleeve defines the depth of the indentation. The corresponding indentation of the reshaped outer conductor contact element comprises multiple bends having in each case a bending radius due to the production procedure. If the wall of the support sleeve is not sufficiently thick, it is possible that sequential bends of the outer conductor contact element merge into one another. This can result in the positive-locking connection between the outer conductor contact element and the cable that is pre-assembled with the support sleeve disadvantageously losing its holding force.

Taking into consideration the known prior art, the object of the present invention is to provide an outer conductor contact element that combines, in particular, an improved holding force on a cable with advantageous electrical properties.

The present invention also has the object to provide a plug connector arrangement that combines, in particular, an improved holding force of an outer conductor contact element on a cable with advantageous electrical properties.

Finally, it is also an object of the invention to provide an improved assembly method for a plug connector arrangement, in particular, in order to increase the holding force of an outer conductor contact element on a cable.

An outer conductor contact element is provided for a plug connector arrangement.

The plug connector arrangement is described in detail below, and can comprise in particular an electrical plug connector (or individual plug connector components of the electrical plug connector) and an electrical cable to which are fastened the plug connector or, the plug connector components of the plug connector.

It is preferred that the plug connector arrangement, or the plug connector of the plug connector arrangement, comprises in addition to the outer conductor contact element, an inner conductor contact element, a support sleeve and optionally a housing assembly, as will be described.

The outer conductor contact element can be assembled on the cable, in particular it can be secured in the circumferential direction (against rotation) and/or in an axial manner along the longitudinal axis of the plug connector arrangement (against being pulled off from the cable).

The outer conductor contact element can be embodied as one piece or from multiple pieces. It is preferred that the outer conductor contact element is shaped from at least one metal sheet.

The outer conductor contact element can contact an outer conductor of the cable in an electrical and mechanical manner or can be connected in an electrical manner at least indirectly to the outer conductor of the cable. The outer conductor contact element can be embodied in order to shield inner-lying plug connector components of the plug connector in an electromagnetic manner (for example an inner conductor contact element) and/or in order to render it possible to connect the outer conductor of the cable in an electrical manner to a corresponding outer conductor contact element of a mating plug connector.

The outer conductor contact element can comprise in the region of its front free end, an interface so as to make electrical and/or mechanical contact with a mating plug connector, in particular with a corresponding outer conductor contact element of a mating plug connector. The specific configuration of the interface can depend upon the intended plug connector standard. The interface can comprise for example a resilient tab or multiple resilient tabs, preferably a so-called resilient basket.

The outer conductor contact element can be embodied so that it can be assembled on, in particular pressed onto, preferably crimped onto, a support sleeve and/or onto an outer conductor of the cable and/or onto a cable sheath of the cable.

An outer conductor of the cable can be, in particular, a cable shielding braid that comprises individual wires that are braided together. Fundamentally, however, any desired outer conductor can be provided.

In accordance with the invention, the outer conductor contact element comprises at least one fixing stop which, when the outer conductor contact element is in an assembled state on a support sleeve, is able to engage behind a cable-side end face of the support sleeve along the longitudinal axis of the plug connector arrangement, said cable-side end face being remote from a front, free end of the outer conductor contact element.

By virtue of the fixing stop, which extends preferably in the radial direction or to a greater extent in an orthogonal manner with respect to the longitudinal axis in the direction of the longitudinal axis, it is possible to provide in the axial direction a positive-locking connection for the outer conductor contact element. In particular, if the support sleeve is fastened in a known manner on the outer conductor of the cable, it is thereby possible to provide a sufficient holding force for the outer conductor contact element. Insofar as further plug connector components of the plug connector are connected to the outer conductor contact element, for example a housing assembly of the plug connector, it is consequently also possible to improve its holding force.

In addition to the positive-locking connection, it is also possible to provide by means of a pressing-on procedure, preferably a crimping-on procedure, a non-positive locking connection between the outer conductor contact element and the support sleeve, the outer conductor of the cable and/or the cable sheath of the cable. However, by virtue of the positive-locking connection that is already provided, it is possible to reduce the still required pressing force, as a result of which it is possible to reduce the extent of the deformation of the support sleeve or of the cable or where possible even completely avoid such deformation. This renders it possible to improve the electrical properties of the plug connector that is fastened to the cable.

In accordance with a first variant, in accordance with the invention, it is provided that the fixing stop is formed in the outer conductor contact element by means of a male connector-side edge of a material cut-out that is provided in the outer conductor contact element, said male connector-side edge facing the front, free end of the outer conductor contact element.

In accordance with a second variant, in accordance with the invention, it is provided that the fixing stop is formed in the outer conductor contact element by means of a separate stop element that is fastened to the inner wall of the outer conductor contact element.

In accordance with a third variant, in accordance with the invention, it is provided that the fixing stop is formed in the outer conductor contact element by means of a stamped shaping which is provided in the outer conductor contact element when the outer conductor contact element is in the unassembled state.

The said three variants, in accordance with the invention, represent alternative and combination solutions for the common object in accordance with the invention. The three variants are associated with one another in particular also to the extent that an advantageous fixing stop is provided as an edge in the outer conductor contact element, preferably even prior to the outer conductor contact element being assembled.

In particular, when more than one fixing stop is provided, the variants in accordance with the invention can be combined with one another in any desired manner.

All three variants, in accordance with the invention, have in common the advantage that a support surface can be formed in the outer conductor contact element for the support sleeve, preferably a support surface having an orthogonal end face (with regard to the longitudinal axis of the plug connector arrangement). By virtue of this axial support on the support sleeve, the outer conductor contact element (and consequently the plug connector) is held in an optimal manner against the electrical cable. In contrast to the known prior art, it is possible to provide a high holding force even if the wall thickness of the support sleeve is relatively thin or the indentation between the support sleeve and the cable sheath of the cable is only shallow. Since the fixing stop is embodied not exclusively by means of a pressing-in procedure in the outer conductor contact element, the number of bending radii can be reduced and where possible a fixing stop can even be provided that does not have any bending radii in the section in question.

It is possible in accordance with the invention to provide for example particularly robust plug connectors for use in the high frequency technology, the support sleeves of which have only a relatively thin wall thickness, as a result of which the plug connectors can furthermore be embodied particularly small.

In accordance with one development of the invention, it is possible to provide that the material cut-out is embodied in the outer conductor contact element as an in part annular circumferential slit.

The in part annular circumferential slit can describe for example a circular arc having a middle point angle of 10° to 180°, preferably 20° to 120°, further preferred 45° to 90°.

It is also possible to provide multiple fixing stops by means of multiple material cut-outs that are arranged in a distributed manner along the circumference of the outer conductor contact element and that are preferably arranged along the longitudinal axis of the outer conductor contact element at the same axial position. It is possible for example to provide two in part annular circumferential slits, three in part annular circumferential slits, four in part annular circumferential slits, five in part annular circumferential slits, six in part annular circumferential slits or even more in part annular circumferential slits.

In accordance with one development of the invention, it is possible to provide that the material cut-out is provided in the outer conductor contact element in such a manner that the outer conductor contact element forms a tab that is connected on one side, wherein the free, male connector-side edge of the tab forms the fixing stop.

For example, it is possible to provide a U-shaped material cut-out so as to form the tab.

It is preferred that the male connector-side edge of the tab comprises a linear or straight extension in order to form an end-side fixing stop that covers the entire surface as far as possible.

Insofar as it is possible to form multiple fixing stops in the outer conductor contact element, it is also possible to form multiple tabs along the circumference of the outer conductor contact element, said multiple tabs being preferably arranged along the longitudinal axis of the outer conductor contact element at the same axial position. For example, it is possible to provide two tabs, three tabs, four tabs, five tabs, six tabs or even more tabs.

In one development of the invention, it is possible to provide that the outer conductor contact element is reshaped adjacent to the male connector-side edge of the material cut-out in the direction of the longitudinal axis.

In particular, it is possible by virtue of reshaping the outer conductor contact element in the region of the male connector-side edge of the slit or the tab in the direction of the longitudinal axis to form the fixing stop in particular in an advantageous manner.

It is preferred that the outer conductor contact element is simultaneously accordingly reshaped during the pressing-on procedure onto the support sleeve, said procedure generally already being provided. However, the outer conductor contact element can also be accordingly reshaped earlier in the unassembled state adjacent to the male connector-side edge of the material cut-out in the direction of the longitudinal axis.

In one development of the invention, it is possible to provide that the separate stop element is a sheet metal element, a metal connecting piece and/or a wire part.

The stop element and the outer conductor contact element are preferably formed as multiple parts. It is preferred that the stop element is connected in a positive-locking manner to the outer conductor contact element, for example by means a clinching method. However, it is also possible to provide a different connecting method, for example also a firmly bonded connecting method.

Insofar multiple fixing stops are provided in the outer conductor contact element, it is possible to provide multiple stop elements (that are embodied in each case as a sheet metal element, as a metal connecting piece and/or as a wire part). The stop elements can be arranged in a distributed manner along the circumference of the outer conductor contact element on the inner wall, preferably along the longitudinal axis of the outer conductor contact element at the same axial position. For example, it is possible to provide two stop elements, three stop elements, four stop elements, five stop elements, six stop elements or even more stop elements.

It is possible in one advantageous development of the invention to provide that the stamped shaping that is provided in the outer conductor contact element is embodied as an in part annular connecting piece, or as a completely annular circumferential connecting piece, that extends in the direction of the longitudinal axis starting from the inner wall of the outer conductor contact element.

It is particularly preferred that the connecting piece is provided in only an in part annular circumferential manner; fundamentally however it is also possible to provide a completely annular circumferential connecting piece. The in part annular circumferential connecting piece can describe for example a circular arc having a middle point angle of 10° to 180°, preferably 20° to 120°, further preferred 45° to 90°.

It is also possible to provide multiple fixing stops by means of multiple stamped shapings that are arranged in a distributed manner along the circumference of the outer conductor contact element and that are preferably arranged along the longitudinal axis of the outer conductor contact element at the same axial position. It is possible for example to provide two in part annular circumferential connecting pieces, three in part annular circumferential connecting pieces, four in part annular circumferential connecting pieces, five in part annular circumferential connecting pieces, six in part annular circumferential connecting pieces or even more in part annular circumferential connecting pieces.

The invention also relates to a plug connector arrangement comprising a support sleeve, which is fastened to an outer conductor of an electrical cable, and an outer conductor contact element that is assembled on the support sleeve, in particular an outer conductor contact element that is described herein.

It can be preferably provided that the plug connector arrangement comprises the electrical cable. Consequently, the electrical cable can be regarded within the scope of the invention as part of the plug connecter arrangement. Fundamentally, the electrical cable can however also be independent of the plug connector arrangement.

In an advantageous manner, it is possible to provide a plug connector arrangement having an outer conductor contact element having an integrated fixing stop, in particular by means of a material cut-out, or by means of revealing and subsequently reshaping the outer conductor contact element. This renders it possible to optimize the holding force of the plug connector on the cable.

It is preferred that the support sleeve can comprise a holding means, for example a bendable tab or multiple bendable tabs, in order to apply to the cable, or the outer conductor of the cable, a force which acts radially inwards in the direction of the longitudinal axis of the plug connector arrangement. This renders it possible to prevent the support sleeve shifting on the cable.

The support sleeve can be pressed onto the outer conductor of the cable.

In one development of the invention, it is possible to provide that the outer conductor of the cable, in particular an outer conductor of the cable that is embodied as a cable shielding braid, is folded back at least in sections over the support sleeve.

It is possible in this manner to realize an advantageous electrical and mechanical connection or contact between the outer conductor of the cable and the outer conductor contact element of the plug connector.

Furthermore, in a particularly preferred development, it is possible to provide that the outer conductor of the cable, in particular the cable shielding braid, is folded back over the support sleeve in such a manner that a front, free end of the outer conductor, or of the cable shielding braid, protrudes over a cable-side edge of the support sleeve.

This renders it possible to further improve the holding force of the outer conductor contact element on the cable since the outer conductor or the cable shielding braid can be clamped between the fixing stop and the cable-side end face of the support sleeve. Axial forces that subsequently act on the outer conductor contact element along the longitudinal axis of the cable can consequently be advantageously dissipated via the outer conductor, or via the cable shielding braid. It is possible in this manner to fasten the outer conductor contact element to the cable without it being necessary for the outer conductor or the cable shielding braid to deform in the direction of the longitudinal axis.

In one advantageous development of the invention, it is possible to provide that the outer conductor contact element is pressed onto the support sleeve, preferably crimped.

The outer conductor contact element can be pressed onto the support sleeve in a radial and/or axial manner.

In addition, the outer conductor contact element can be pressed, preferably crimped, onto the cable sheath of the cable, the outer conductor of the cable and/or onto further cable components of the cable (for example a cable film or an insulation of an inner conductor of the cable).

In one advantageous development of the invention, it is possible to provide that the plug connector arrangement comprises an inner conductor contact element that is fastened to an inner conductor of the electrical cable. It is preferred that the inner conductor contact element extends at least in sections along the longitudinal axis through the outer conductor contact element.

It is particularly preferred that the plug connector arrangement is embodied in a coaxial manner, wherein the inner conductor contact element extends in a coaxial manner through the outer conductor contact element.

In one embodiment of the invention, it is possible to provide that the plug connector arrangement comprises an insulation element that is arranged between the inner conductor contact element and the outer conductor contact element.

Furthermore, it is possible in one embodiment of the invention to provide that the plug connector arrangement comprises a housing assembly, preferably a housing assembly that is embodied from a synthetic material. The housing assembly can comprise a receiving device in order to receive at least one outer conductor contact element. It is possible to provide latching means so as to fasten the at least one outer conductor contact element.

The plug connector, in accordance with the invention, can be used in particular advantageously within a vehicle, in particular within a motor vehicle. The term "vehicle" describes in this case any transportation means, in particular land-borne, water-borne or air-borne vehicles, including also spacecraft.

Possible application areas are in particular autonomous driving, driver assist systems, navigation systems, "infotainment" systems, rear seat entertainment systems, internet connections and wireless Gigabit (IEEE 802 11ad Standard). Possible applications relate to high resolution cameras, for example 4K- and 8K-cameras, sensor systems, on-board computers, high resolution screens, high resolution instrument panels, 3D navigation devices and mobile communication devices.

However, the plug connector in accordance with the invention is suitable for any desired applications within the entire electronic industry and it is not to be understood to be limited to the use in the automotive industry.

The electrical plug connector and the electrical plug connection are not limited to a specific plug connector type, wherein the invention is particularly suitable for plug connectors and plug connections for use in high frequency technology. For example, and without limitation, is possible to provide plug connectors or plug connections of the type PL, BNC, TNC, SMBA (FAKRA), SMA, SMB, SMS, SMC, SMP, BMS HFM (FAKRA-Mini), H-MTD, BMK, Mini-Coax or MATE-AX.

The invention relates also to an assembly method for a plug connector arrangement. It is provided that an outer conductor contact element is assembled on a support sleeve, which is fastened to an electrical cable, in such a manner that a fixing stop of the outer conductor contact element engages behind a cable-side end face of the support sleeve along the longitudinal axis of the plug connector arrangement, said cable-side end face being remote from the front, free end of the outer conductor contact element.

In accordance with a first variant, in accordance with the invention of the assembly method, it is provided that the fixing stop is formed in the outer conductor contact element, in that a material cut-out is provided in the outer conductor contact element. It is preferred that it is possible to provide that a male connector-side edge of the material cut-out is reshaped in the direction of the longitudinal axis of the plug connector arrangement, said male connector-side edge facing the front, free end of the outer conductor contact element. It is preferred that the male connector-side edge of the material cut-out is reshaped during the procedure of pressing the outer conductor contact element onto the support sleeve.

In accordance with a second variant, in accordance with the invention of the assembly method (alternatively or in addition to the other variants), it is provided that the fixing stop is formed in the outer conductor contact element in that a separate stop element is fastened to the inner wall of the outer conductor contact element.

In accordance with a third variant, in accordance with the invention of the assembly method (alternatively or in addition to the other variants), it is provided that the fixing stop is formed in the outer conductor contact element in that a stamped shaping is provided in the outer conductor contact element when the outer conductor contact element is in the unassembled state.

The variants, in accordance with the invention of the assembly method, have in common that the outer conductor contact element can be advantageously pre-processed or prepared, and preferably subsequently reshaped by means of a reshaping process, preferably a crimping process, in such a manner that the reshaped region of the outer conductor contact element forms an axial, end-side supporting surface for the support sleeve. This renders it possible to improve the holding force of the outer conductor contact element and consequently of the entire plug connector on the (pre-assembled) cable in comparison with the prior art.

In one development of the invention, it is possible to provide that the outer conductor contact element will be produced or is produced by means of a stamping-bending process.

It is preferred that the stop element is fastened to the inner wall of the outer conductor contact element after the outer conductor contact element has been produced within the scope of the stamping-bending process and prior to the outer conductor contact element being pushed onto the (pre-assembled) cable for assembly purposes.

In accordance with one development of the invention, it is possible to provide that the material cut-out is provided in the outer conductor contact element prior to the outer conductor contact element being assembled on the support sleeve, preferably it is provided in the outer conductor contact element during the stamping-bending process.

However, it is also possible to provide that the material cut-out is provided in the outer conductor contact element simultaneously as the outer conductor contact element is assembled on the support sleeve, for example by means of a pressing tool having an integrated stamping element.

In one advantageous development of the invention, it is possible to provide that the separate stop element is fastened to the inner wall of the outer conductor contact element by means of a clinching process.

Features that have been described in connection with the outer conductor contact element in accordance with the invention can naturally also be used for the plug connector arrangement and the assembly method—and conversely. Moreover, advantages that have already been mentioned in connection with the outer conductor contact element can also be understood to relate to the plug connector arrangement and the assembly method—and conversely.

Furthermore, the invention relates also to an outer conductor contact element for a plug connector arrangement, comprising at least one fixing stop which, when the outer conductor contact element is in an assembled state on the support sleeve, is able to engage behind a cable-side end face of the support sleeve along the longitudinal axis of the plug connector arrangement, said cable-side end face being remote from the front, free end of the outer conductor contact element, wherein the fixing stop in the outer conductor contact element is already provided in the outer conductor contact element when the outer conductor contact element is in the unassembled state or wherein the outer conductor contact element is at least prepared in the unassembled state in order to form the fixing stop. The features described in the present description relate to advantageous embodiments and variants regarding this.

In addition, reference is made to the fact that terms such as "including", "comprising" or "having" do not exclude other features or steps. Moreover, the terms "a" or "the" that refer to a single number of steps or features do not exclude a plurality of features or steps—and conversely.

However, it is also possible in one puristic embodiment of the invention to provide that the features that are disclosed in the invention with the terms "including", "comprising" or "having" are exhaustively listed. Accordingly, one or multiple listings of features can be considered within the scope of the invention as exhaustive, for example can be considered for each claim respectively.

It is to be mentioned that references such as "first" or "second" etc. are used primarily for reasons of distinguishability between respective device features or method features and are not absolutely intended to indicate that features are mutually dependent or are in relation to one another.

Moreover, it is to be emphasized that the currently described values and parameters include deviations or fluctuations of ±10% or less, preferably ±5% or less, further preferred ±1% or less, and quite particularly preferred ±0.1% or less of the respectively quoted value or parameter insofar as these deviations are not excluded in the case of the invention being implemented in practice. The specification of ranges by means of a starting value and an end value also includes all those values and fractions that are included by the respectively quoted range, in particular the start value and the end value and a respective middle value.

Exemplary embodiments of the invention are explained in detail below with reference to the drawings.

The figures illustrate in each case preferred exemplary embodiments in which individual features of the present invention are represented in combination with one another. Features of an exemplary embodiment are also implemented separately from the other features of the same exemplary embodiment and can accordingly be readily combined by a person skilled in the art to for further expedient combinations and sub-combinations having features of other exemplary embodiments.

Like-functioning elements are provided with the same reference numerals in the figures.

Exemplary embodiments of the invention are described in more detail below with reference to the drawings.

SUMMARY

It is a principal aspect of the present invention is to provide an outer conductor contact element for a plug connector arrangement, comprising at least one fixing stop which, when the outer conductor contact element is in an assembled state on a support sleeve, is able to engage behind a cable-side end face of the support sleeve along the longitudinal axis (L) of the plug connector arrangement, said cable-side end face being remote from a front, free end of the outer conductor contact element characterized in that the fixing stop is formed in the outer conductor contact element by means of a male connector-side edge of a material cut-out that is provided in the outer conductor contact element, said male connector-side edge facing the front, free end of the outer conductor contact element; and/or by means of a separate stop element that is fastened to the inner wall of the outer conductor contact element; and/or by means of a stamped shaping that is provided in the outer conductor contact element when the outer conductor contact element is in the unassembled state.

A further aspect of the present invention is to provide an outer conductor contact element, characterized in that the material cut-out is formed in the outer conductor contact element as an in part annular circumferential slit.

A further aspect of the present invention is to provide an outer conductor contact element, characterized in that the material cut-out is provided in the outer conductor contact element in such a manner that the outer conductor contact element forms a tab that is connected on one side, wherein the free, male connector-side edge of the tab forms the fixing stop.

A further aspect of the present invention is to provide an outer conductor contact element, characterized in that the outer conductor contact element is reshaped adjacent to the male connector-side edge of the material cut-out in the direction of the longitudinal axis (L).

A further aspect of the present invention is to provide an outer conductor contact element, characterized in that the separate stop element is a sheet metal element or a wire part.

A further aspect of the present invention is to provide an outer conductor contact element, characterized in that the stamped shaping that is provided in the outer conductor contact element is formed as an in part annular connecting piece that extends starting from the inner wall of the outer conductor contact element in the direction of the longitudinal axis (L).

A further aspect of the present invention is to provide a plug connector arrangement, comprising an electrical cable, a support sleeve that is fastened to an outer conductor of the electrical cable, and an outer conductor contact element which is assembled on the support sleeve.

A further aspect of the present invention is to provide a plug connector arrangement, characterized in that the outer conductor of the cable is folded back at least in sections over the support sleeve.

A further aspect of the present invention is to provide a plug connector arrangement, characterized in that the outer conductor of the cable is folded back over the support sleeve in such a manner that a front, free end of the outer conductor protrudes beyond a cable-side edge of the support sleeve.

A further aspect of the present invention is to provide a plug connector arrangement, characterized in that the outer conductor contact element is pressed, preferably crimped, onto the support sleeve.

A further aspect of the present invention is to provide a plug connector arrangement, characterized in that the plug connector arrangement comprises an inner conductor contact element that is fastened to an inner conductor of the electrical cable, wherein the inner conductor contact element extends at least in sections along the longitudinal axis (L) through the outer conductor contact element.

A further aspect of the present invention is to provide an assembly method for a plug connector arrangement, according to which an outer conductor contact element is assembled on a support sleeve, which is fastened to an electrical cable, in such a manner that a fixing stop of the outer conductor contact element engages behind a cable-side end face of the support sleeve along the longitudinal axis (L) of the plug connector arrangement, said cable-side end face being remote from the front, free end of the outer conductor contact element characterized in that the fixing stop is formed in the outer conductor contact element in that a material cut-out Is provided in the outer conductor contact element and a male connector-side edge of the material cut-out is reshaped in the direction of the longitudinal axis (L) of the plug connector arrangement, said male connector-side edge facing the front, free end of the outer conductor contact element; and/or a separate stop element is fastened to the inner wall of the outer conductor contact element; and/or when the outer conductor contact element is in the unassembled state, a stamped shaping is provided in the outer conductor contact element.

A further aspect of the present invention is to provide an assembly method, characterized in that the outer conductor contact element is produced by means of a stamping-bending process.

A further aspect of the present invention is to provide an assembly method, characterized in that the material cut-out is provided in the outer conductor contact element prior to the outer conductor contact element being assembled on the support sleeve, preferably is provided in the outer conductor contact element during the stamping-bending process.

A further aspect of the present invention is to provide an assembly method, characterized in that the separate stop element is fastened to the inner wall of the outer conductor contact element by means of a clinching process.

These and other aspects of the invention will be described in detail, as is required, herein.

BRIEF DESCRIPTIONS OF THE DRAWINGS

DETAILED WRITTEN DESCRIPTION OF THE PREFERRED EMBODIMENTS

This disclosure of the invention is submitted in furtherance of the Constitutional purposes of the U.S. Patent Laws "to promote the progress of science and the useful arts." (Article 1, Section 8).

Figure 1:
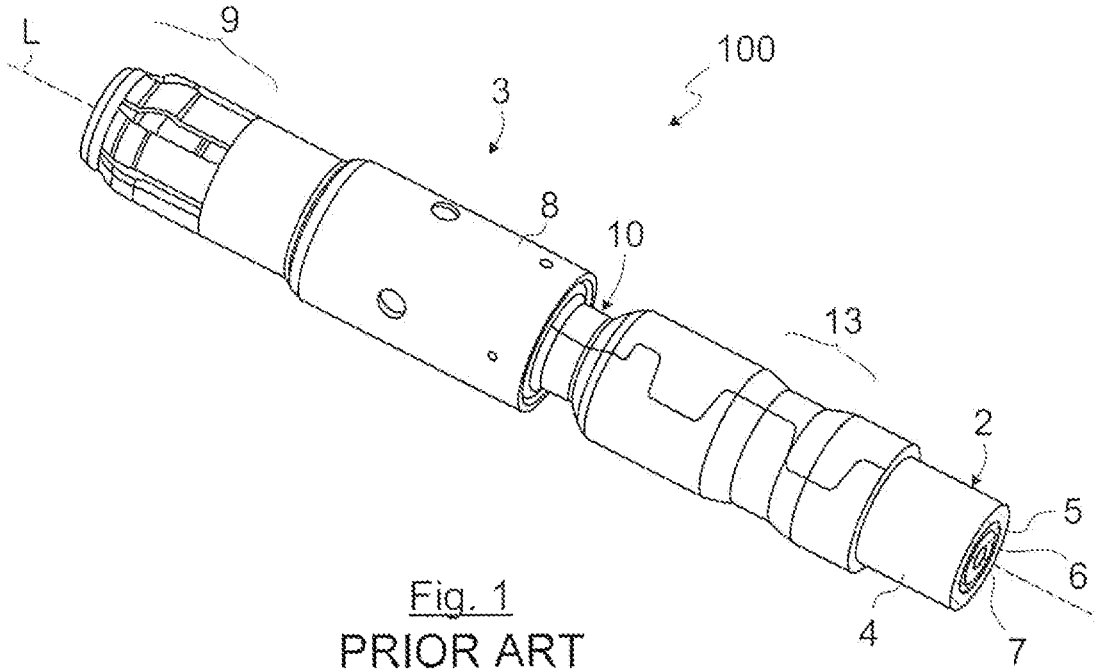
Fig. 1 PRIOR ART
FIG. 1 illustrates a perspective view of a prior art plug connector arrangement having an outer conductor contact element.

FIG. 1 illustrates a plug connector arrangement 100 in accordance with the prior art. The plug connector arrangement 100 comprises an electrical cable 2 and an electrical plug connector 3 that is assembled on the cable 2.

The electrical cable 2 is embodied as a coaxial cable and comprises a cable sheath 4, an outer conductor that runs underneath the cable sheath 4 and is embodied as a cable shielding braid 5, optionally a cable film (not illustrated in the figures) that runs underneath the cable shielding braid 5, an insulation or a dielectric 6 and an inner conductor 7 that extends through the dielectric 6. The invention is described below with reference to the same cable type. Fundamentally, however, the invention is suitable for use with any desired cables, for example also for use with cables that are not embodied as coaxial cables, and/or comprise multiple inner conductors 7.

The electrical plug connector 3 comprises multiple plug connector components of which only the outer conductor contact element 8 is illustrated in FIG. 1. Further plug connector components that can be provided optionally within the scope of the plug connector arrangement 1 in accordance with the invention are further explained below.

The outer conductor contact element 8 is assembled on the cable 2 and preferably fixed in the circumferential direction or radial direction (around the longitudinal axis L of the plug connector arrangement 100) and in the axial direction (along the longitudinal axis L of the plug connector arrangement 100). Since the outer conductor contact element 8 is generally connected to the further plug connector components, a high holding force of the outer conductor contact element 8 on the cable 2 can define the mechanical stability of the entire plug connector 3.

In the region of the front, free end of the outer conductor contact element 8, the outer conductor contact element 8 comprises an interface 9 so as to contact a corresponding outer conductor contact element of a mating plug connector (not illustrated). In the case of the outer conductor contact element 8 shown in FIG. 1 and in the case of the outer conductor contact elements 8 illustrated in the exemplary embodiments respectively, the interface 9 is embodied as a resilient basket but fundamentally it can be embodied as desired.

The outer conductor contact element 8 is connected in the region of its cable-side end to the cable 2. It is provided in the prior art for this purpose that the cable 2 is held on the one hand in the region of a tapering 10. Furthermore, a support sleeve 11 (not visible in FIG. 1) is provided in a connecting region and said support sleeve 11 is pressed onto the outer conductor or onto the cable shielding braid 5 of the cable 2. Starting from a rear cable-side end face 12, the support sleeve 11 together with the cable sheath 4 forms an indentation 13 on the cable 2 into which the outer conductor contact element 8 is able to penetrate due to a reshaping process during the assembly procedure. This renders it possible to provide in addition to a non-positive locking arrangement also a positive-locking arrangement along the longitudinal axis L of the plug connector arrangement 100. In this case, the holding force that is provided as a result of the positive-locking arrangement is greater the deeper the indentation 13. It is also possible in particular for indentations 13 that are only slightly deep to provide only a small holding force. This is an aspect that is improved in accordance with the invention.

Figure 2:
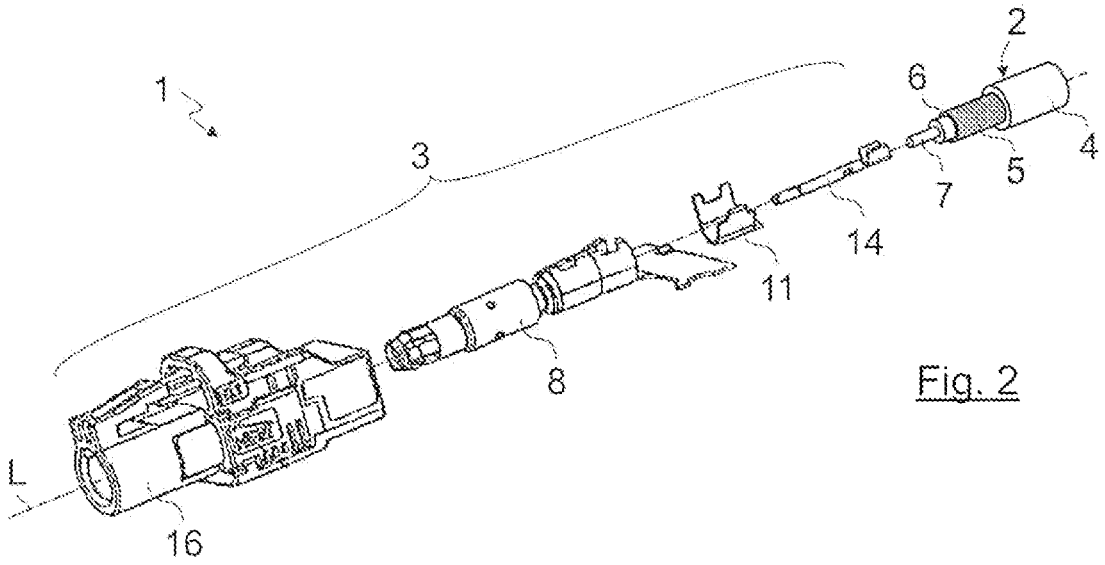
FIG. 2 illustrates a perspective exploded side and end view of advantageous components of a plug connector arrangement in accordance with the invention.

FIG. 2 illustrates a perspective exploded side and end view of advantageous components of a plug connector arrangement 1 in accordance with the invention.

It is possible within the scope of an assembly method for the plug connector arrangement 1 for the electrical cable 2 to be initially pre-assembled. It is possible for this purpose for example for the cable 2 to be initially cut to a defined length. Subsequently, the cable sheath 4 of the cable 2 can be stripped of insulation up to a defined stripped length and consequently the outer conductor or the cable shielding braid 5 of the cable 2 are exposed. Moreover, the inner conductor 7 of the cable 2 is stripped of its insulation or released from the dielectric 6. A correspondingly pre-processed cable section is illustrated in FIG. 2.

An inner conductor contact element 14 can be fastened, preferably pressed or crimped, onto the inner conductor 7 of the cable 2.

Furthermore, it is possible within the scope of the pre-assembly procedure to fasten the support sleeve 11 onto the outer conductor or onto the cable shielding braid 5 of the cable 2. In this case, it is preferred that the cable-side end face 12 of the support sleeve 11 can be spaced apart from the cable sheath 4 of the cable 2 in order to form the indentation 13 (cf. for example FIG. 5 and FIG. 6). Optionally, the outer conductor of the cable 2 or the cable shielding braid 5 can be folded back toward the rear at least in sections, preferably completely, over the support sleeve 11. However, this is not illustrated in the figures for reasons of better presentability.

The outer conductor contact element 8 can be subsequently assembled on the cable 2 that has been pre-assembled in this manner. In this case, the outer conductor contact element 8 can be assembled on the support sleeve 11 in such a manner that a fixing stop 15 of the outer conductor contact element 8 is able to engage behind the cable-side end face 12 of the support sleeve 11 along the longitudinal axis L of the plug connector arrangement 1 (as is yet to be described below).

The outer conductor contact element 8 is preferably pressed, preferably crimped, onto the support sleeve 11.

It is preferred that the outer conductor contact element 8 can be produced by means of a stamping-bending process prior to being pushed onto or prior to being assembled on the pre-assembled cable 2.

It is possible after the outer conductor contact element 8 has been assembled on the pre-assembled cable 2 for the outer conductor contact element 8 to be pushed optionally into a receiving device of a housing assembly 16 and fixed in the receiving device, preferably latched.

Four advantageous exemplary embodiments of the invention are described. It is to be emphasized that the different variants can be combined fundamentally as desired so as to form a fixing stop 15, in particular if more than one fixing stop 15 is provided in the outer conductor contact element 8.

Figure 3:
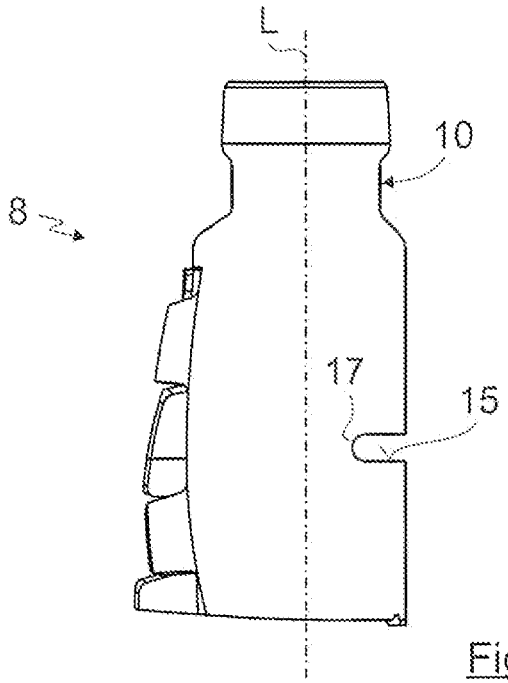
FIG. 3 illustrates a side view of a first exemplary embodiment of an outer conductor contact element in accordance with the invention having an in part annular circumferential slit so as to form a fixing stop.
Figure 4:
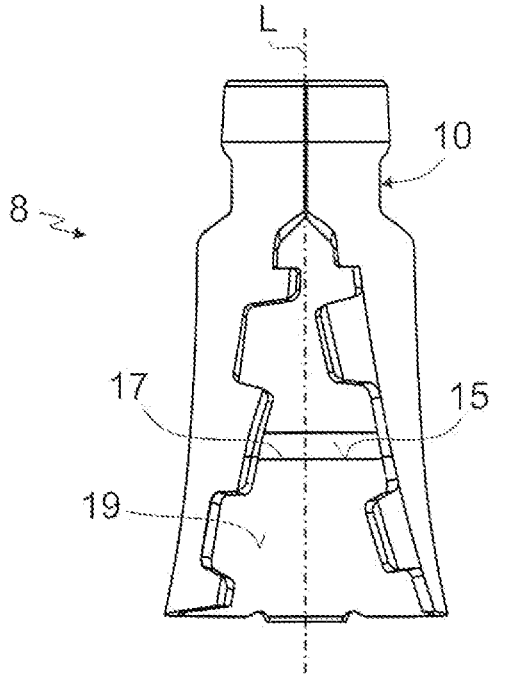
FIG. 4 illustrates a side view of the outer conductor contact element shown in FIG. 3 rotated axially 90 degrees to show the in part annular circumferential slit.
Figure 5:
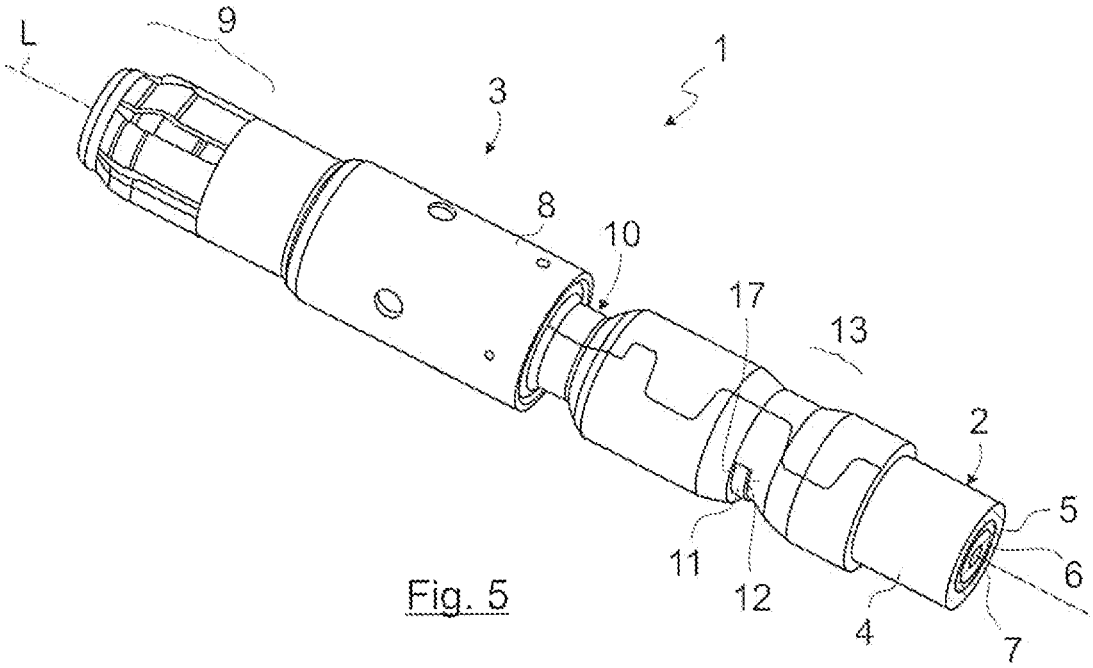
FIG. 5 illustrates a perspective side and end view of the outer conductor contact element shown in FIG. 3 in an assembled state.
Figure 6:
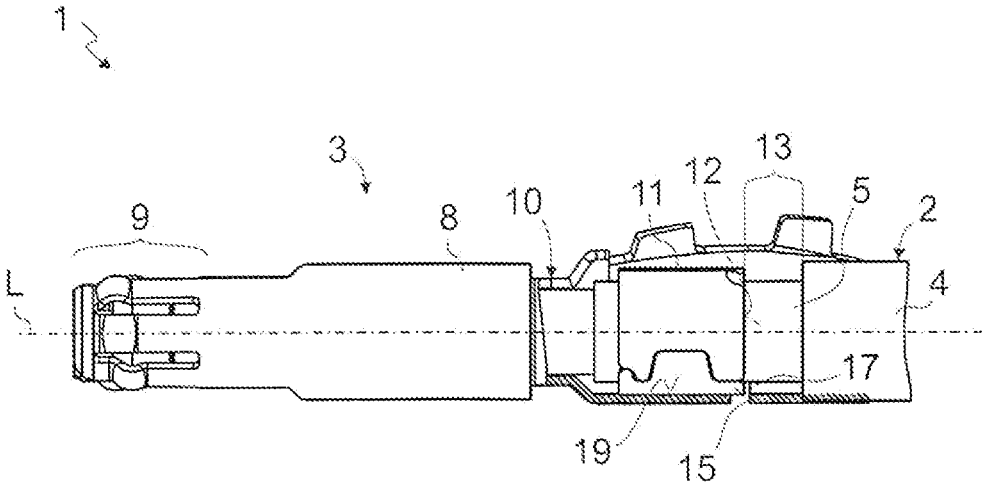
FIG. 6 illustrates a partial section side view of the outer conductor contact element shown in FIG. 3 in a partly assembled state.
Figure 7:
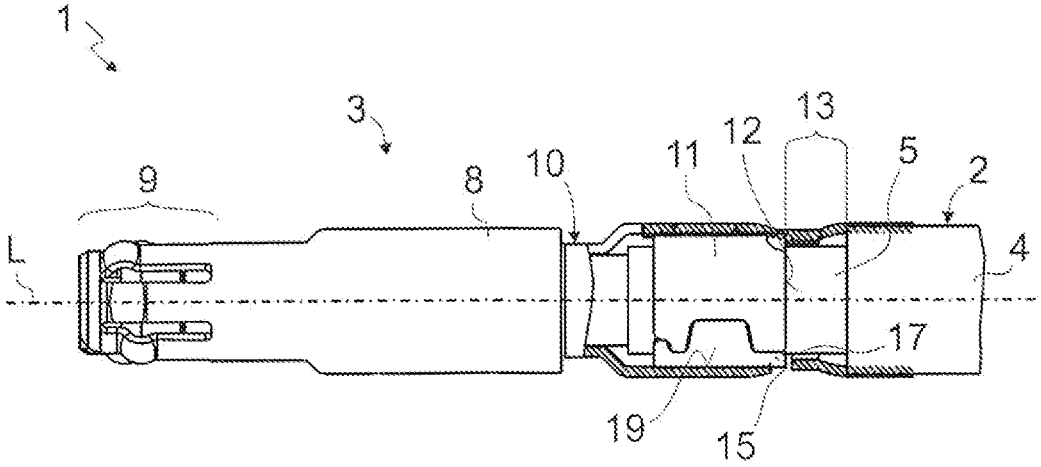
FIG. 7 illustrates a partial sectional side view of the outer conductor contact element shown in FIG. 3 in an assembled state.

FIGS. 3 to 7 illustrate a first exemplary embodiment of an outer conductor contact element 8 in accordance with the invention. FIGS. 3 and 4 illustrate a section of the outer conductor contact element 8 in an individual view. FIGS. 5 to 7 illustrate the outer conductor contact element 8 in a partly assembled or assembled state on the cable 2.

The fixing stop 15 of the outer conductor contact element 8 is formed in the first exemplary embodiment by means of a male connector-side edge of a material cut-out 17 that is provided in the outer conductor contact element 8, said male-connector side edge facing the front, free end of the outer conductor contact element 8. The material cut-out 17 is formed as an in part annular circumferential slit in the exemplary embodiment illustrated in FIGS. 3 to 7. The material cut-out 17 or the slit have already been provided in the outer conductor contact element 8 prior to the outer conductor contact element 8 being assembled, preferably during the stamping-bending process.

The fixing stop 15 can be formed in a reliable manner by means of the male connector-side edge of the material cut-out 17 and can itself then provide a high holding force if the wall thickness of the support sleeve 11 is only thin.

It is possible to provide that the male connector-side edge of the material cut-out 17 or of the slit is reshaped in the direction of the longitudinal axis L of the plug connector arrangement 1 in order to form the fixing stop 15 (cf. FIGS. 6 and 7). In this case, the reshaping occurs advantageously as the outer conductor contact element 8 is pressed onto the support sleeve 11.

Figure 8:
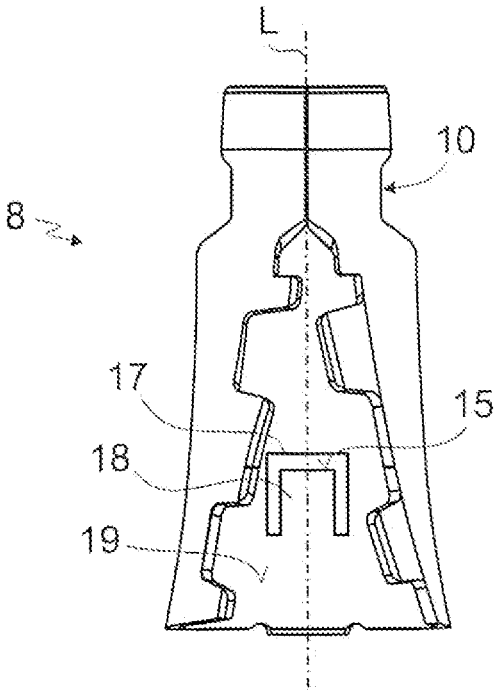
FIG. 8 illustrates a side view of a second exemplary embodiment of an outer conductor contact element in accordance with the invention having a tab so as to form a fixing stop.
Figure 9:
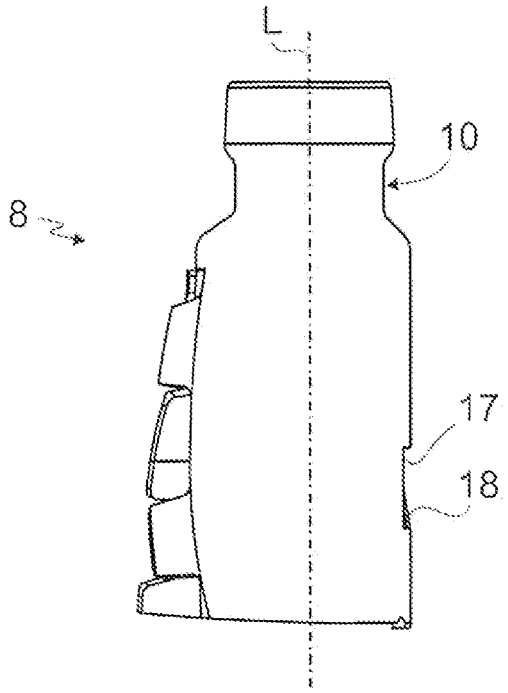
FIG. 9 illustrates a side view of the outer conductor contact element shown in FIG. 8 rotated axially 90 degrees.
Figure 10:
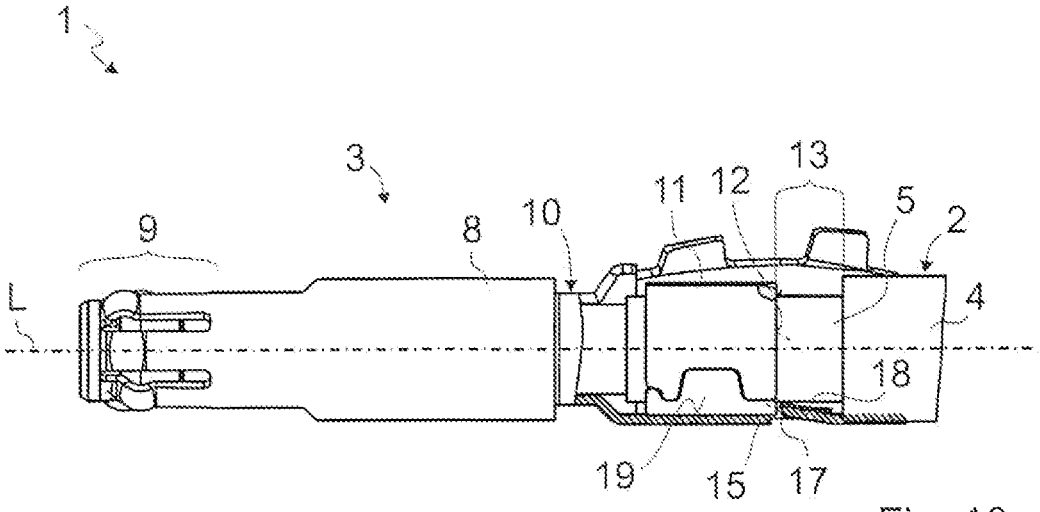
FIG. 10 illustrates a partial sectional side view of the outer conductor contact element shown in FIG. 8 in a partly assembled state.
Figure 11:
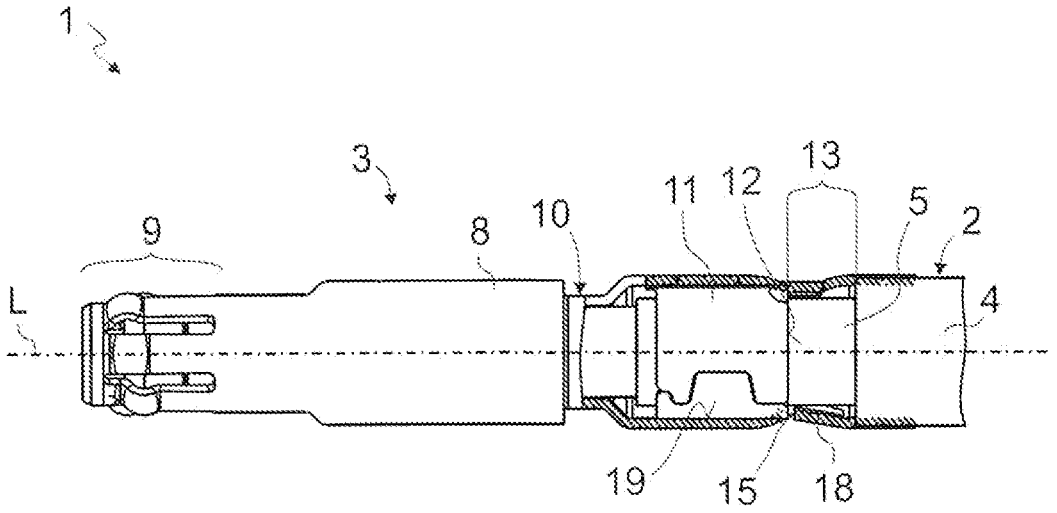
FIG. 11 illustrates a partial sectional side view of the outer conductor contact element shown in FIG. 8 in an assembled state.
Figure 12:
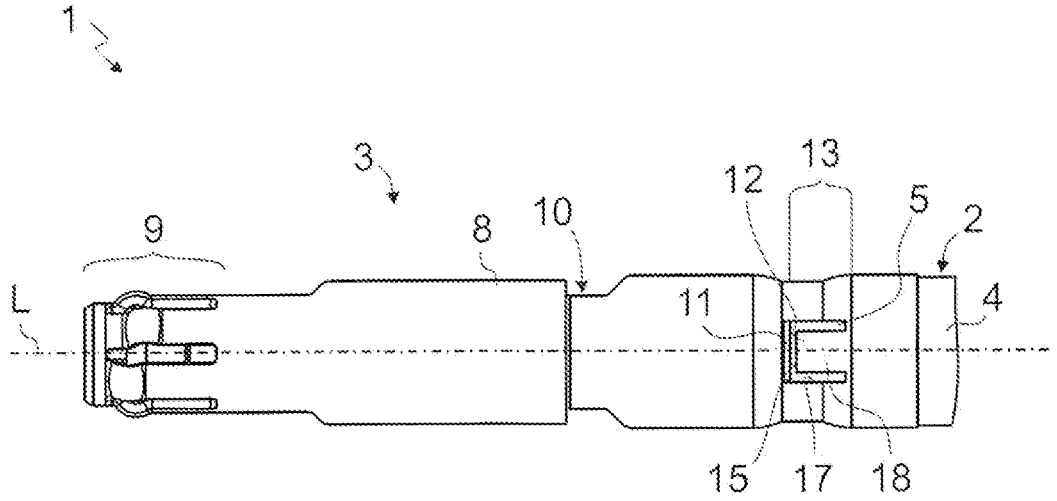
FIG. 12 illustrates a further side view of the outer conductor contact element shown in FIG. 8 in an assembled state.

FIGS. 8 to 12 illustrate a second exemplary embodiment of the outer conductor contact element 8 in accordance with the invention, wherein FIGS. 8 and 9 each illustrate a section of the outer conductor contact element 8 in an individual view and FIGS. 10 to 12 illustrate the outer conductor contact element 8 in a partly assembled state (FIG. 10) and in an assembled state (FIGS. 11 and 12) on the pre-assembled cable 2.

In the second exemplary embodiment, the fixing stop 15 is also formed by means of a material cut-out 17 that is provided in the outer conductor contact element 8. However, the material cut-out 17 is provided in the outer conductor contact element 8 in such a manner that the outer conductor contact element 8 forms a tab 18 that is connected on one side, wherein the free, male connector-side edge of the tab 18 forms the fixing stop 15.

Finally, for example, it is possible by virtue of reshaping the outer conductor contact element 8 within the scope of the assembly procedure to form the fixing stop 15 that is able to secure the outer conductor contact element 8 in a positive-locking manner along the longitudinal axis L of the outer conductor contact element 8 or of the plug connector arrangement 1.

Figure 13:
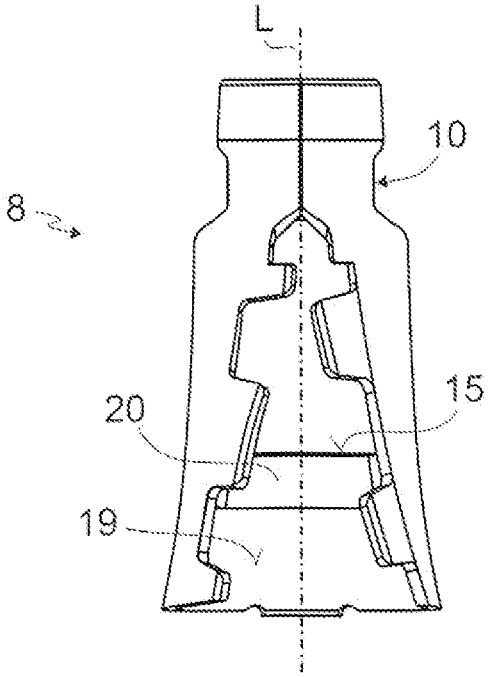
FIG. 13 illustrates a side view of a third exemplary embodiment of an outer conductor contact element in accordance with the invention having a stop element so as to form a fixing stop.
Figure 14:
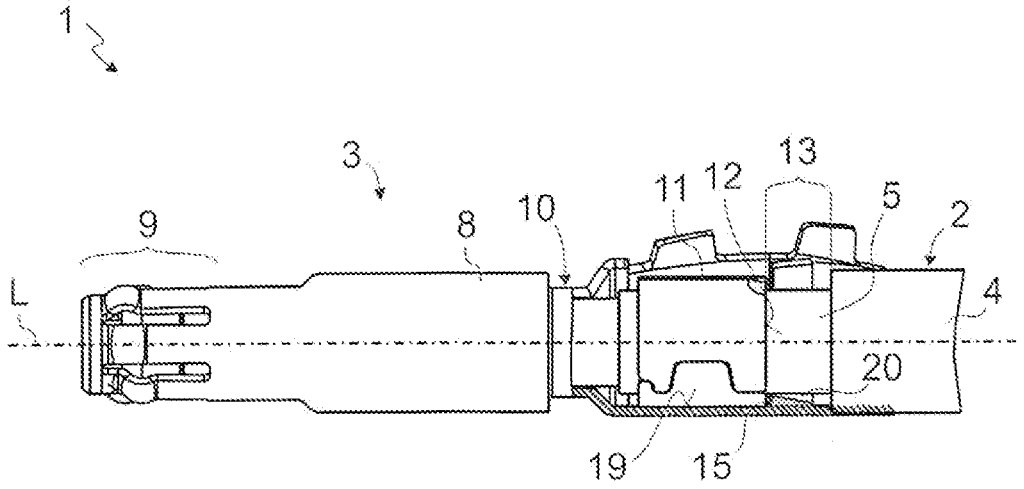
FIG. 14 illustrates a partial sectional side view of the outer conductor contact element shown in FIG. 13 in a first partly assembled state.
Figure 15:
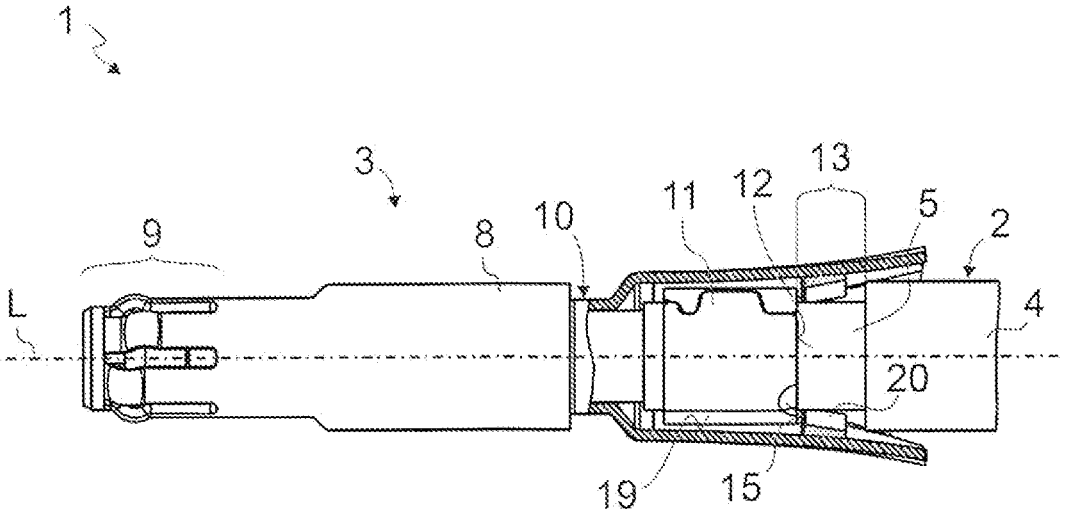
FIG. 15 illustrates a partial sectional side view of the outer conductor contact element shown in FIG. 13 in a second partly assembled state.
Figure 16:
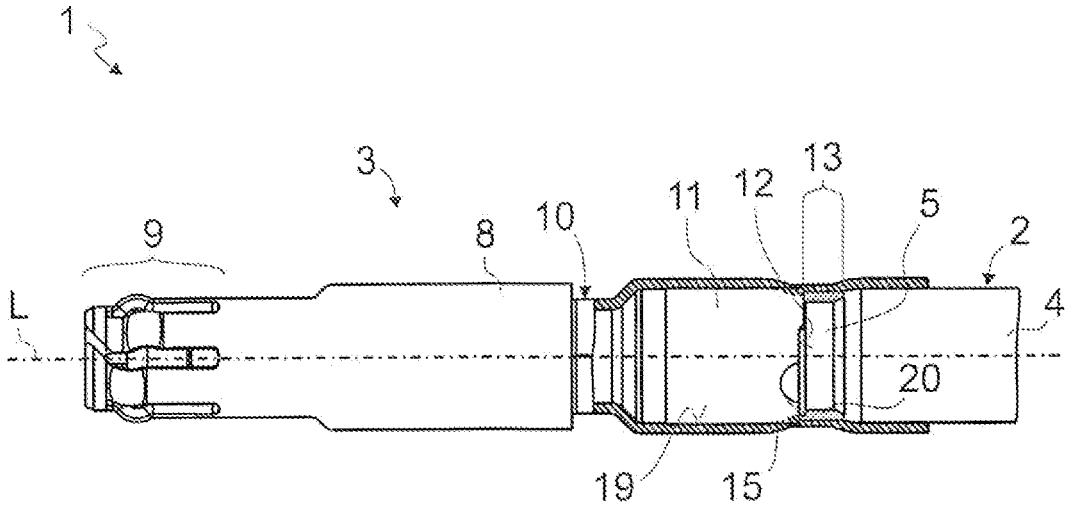
FIG. 16 illustrates a partial sectional side view of the outer conductor contact element shown in FIG. 13 in an assembled state.

FIGS. 13 to 16 illustrate a third exemplary embodiment of an outer conductor contact element 8 in accordance with the invention. FIG. 13 illustrates a section of the outer conductor contact element 8 in an individual view. FIGS. 14 and 15 illustrate the third exemplary embodiment of the outer conductor contact element 8 during the continuing assembly procedure or during the procedure of pressing it onto the support sleeve 11. FIG. 16 illustrates the outer conductor contact element 8 in its assembled state.

In contrast to the first two exemplary embodiments, the fixing stop 15 in the third exemplary embodiment is not formed by means of a material cut-out 17 but rather is formed by means of a separate stop element 20 that is fastened to the inner wall 19 of the outer conductor contact element 8. The stop element 20 can be fastened to the inner wall 19 of the outer conductor contact element 8, for example by means of a clinching procedure or by means of any other method, preferably in a positive-locking manner. This is preferably performed when the outer conductor contact element 8 is still in the unassembled state or prior to said outer conductor contact element 8 being assembled.

In the exemplary embodiment illustrated in FIGS. 13 to 16, the separate stop element 20 is formed as a sheet metal element. Fundamentally, the stop element 20 can however also be formed as a wire part or as any other stop element 20.

Figure 17:
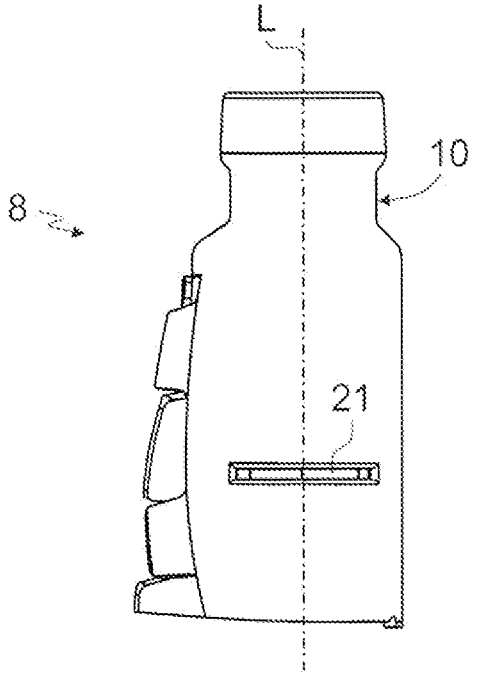
FIG. 17 illustrates a side view of a fourth exemplary embodiment of an outer conductor contact element in accordance with the invention having a stamped shaping so as to form a fixing stop.
Figure 18:
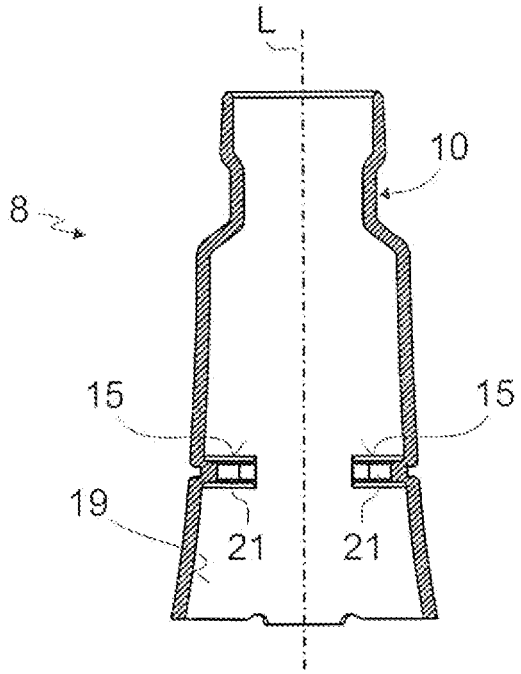
FIG. 18 illustrates a sectional side view of the outer conductor contact element shown in FIG. 17 rotated axially 90 degrees.
Figure 19:
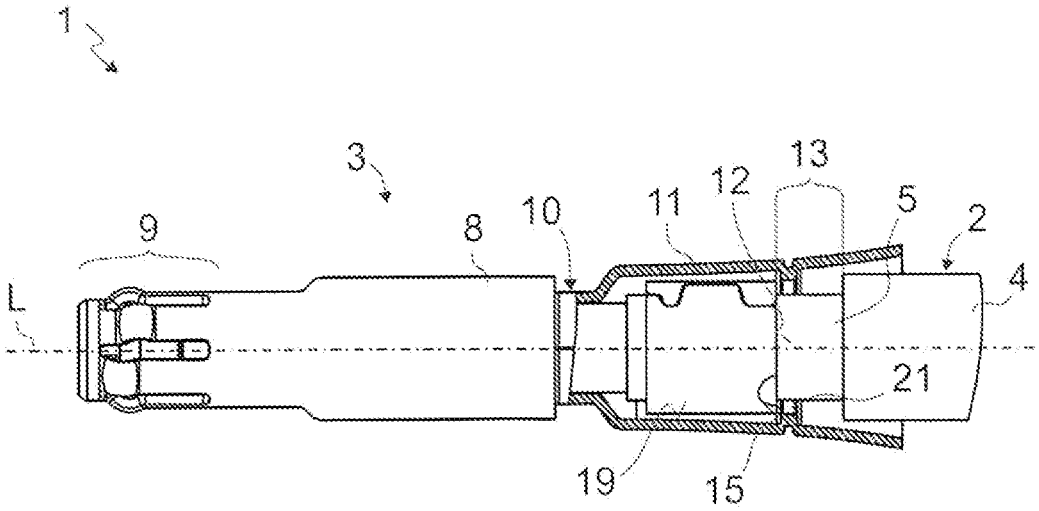
FIG. 19 illustrates a partial sectional side view of the outer conductor contact element shown in FIG. 17 in a partly assembled state.
Figure 20:
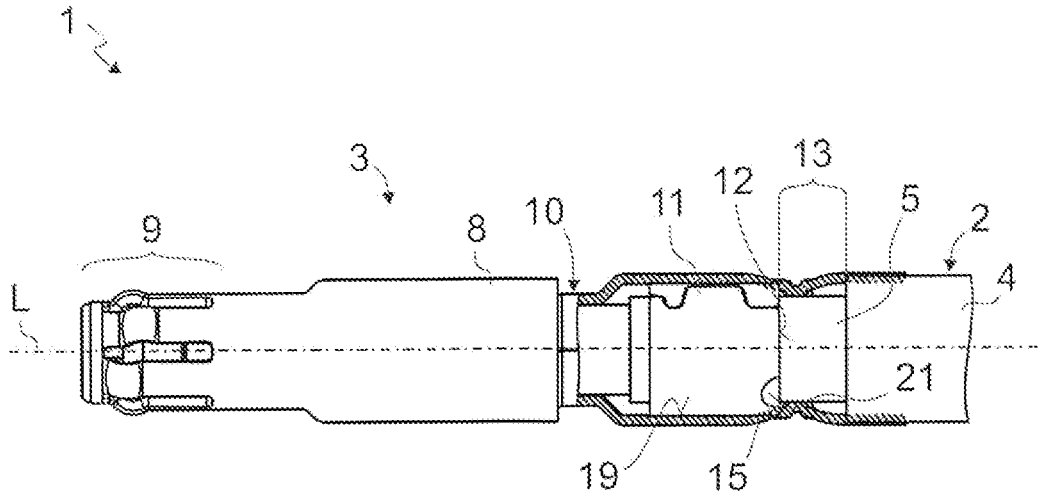
FIG. 20 illustrates a partial sectional side view of the outer conductor contact element shown in FIG. 17 in an assembled state.

Finally, FIGS. 17 to 20 illustrate a fourth exemplary embodiment of the outer conductor contact element 8 in accordance with the invention. FIGS. 17 and 18 illustrate a section of the outer conductor contact element 8 in an individual view. FIG. 19 illustrates an outer conductor contact element 8 in a partly assembled state on the pre-assembled cable 2; FIG. 20 illustrates the outer conductor contact element 8 in an assembled state.

It is provided in the fourth exemplary embodiment that two fixing stops 15 are formed in the outer conductor contact element 8 by means of stamped shapings 21 that are provided in the outer conductor contact element 8 when the outer conductor contact element 8 is in the unassembled state. It is preferred that stamped shaping 21 are provided in the outer conductor contact element 8 within the scope of the stamping-bending process. The stamped shapings 21 are formed in the outer conductor contact element 8 as in part annular connecting pieces. Fundamentally, it is possible to provide any number of stamped shapings 21, but for example it is also possible to provide only one single stamped shaping 21. It is also possible to provide a stamped shaping that forms a completely annular circumferential connecting pike.

As mentioned herein, it is fundamentally possible to provide any number of fixing stops 15 in the outer conductor contact element 8. For example, in the fourth exemplary embodiment two in part annular connecting pieces are described in order to form two fixing stops 15. Fundamentally, each of the illustrated fixing stops 15 can be provided a number of times in each exemplary embodiment, wherein also combinations of different types of fixing stops 15 are possible within the scope of the invention.

OPERATION

Having described the structure of our outer conductor element, plug connector arrangement and assembly method for a plug connector arrangement, its operation is briefly described.

An electrical cable (2) is provided and a portion of the cable sheath (4) is removed from the electrical cable (2) so as to expose the outer conductor (5) which may be a cable shielding braid, a cable film or other conductor. Similarly, the dielectric (6) is removed to expose the inner conductor (7). The inner conductor contact element (14) is fastened onto the inner conductor (7). The outer conductor (5) is folded back (opposite terminal end of the electrical cable (2)) and over the cable sheath (4). The support sleeve (11) is provided, and the support sleeve (11) has a cable-side end face (12). The support sleeve (11) is fastened onto the electrical cable (2) and in contact with the exposed and folded back outer conductor (5). The outer conductor contact element (8) is provided and the outer conductor contact element (8) has a longitudinal axis (L), a front, free end, and a fixing stop (15). The fixing stop (15) is formed in the outer conductor contact element (8) by a material cut-out (17) provided in the outer conductor contact element (8), and a male connector-side edge of the material cut-out (17) is reshaped in the direction of the longitudinal axis (L) of the plug connector arrangement (1), and the male connector-side edge is proximate to the front, free end of the outer conductor contact element (8). Alternatively, or in addition thereto, the fixing stop (15) is formed in the outer conductor contact element (8) by a separate stop element (20) that is fastened to the inner wall (19) of the outer conductor contact element (8). Alternatively, or in addition thereto, the fixing stop (15) is formed in the outer conductor contact element (8) by means of a stamped shaping (21) that is provided in the outer conductor contact element (8) when the outer conductor contact element (8) is in the unassembled state. The outer conductor contact element (8) is assembled on the support sleeve (11) that is fastened on the electrical cable (2)

so that the fixing stop (15) engages behind the cable-side end face of the support sleeve (11) and is remote from the front, free end of the outer conductor contact element (8) and along the longitudinal axis (L).

It is a principal object of the present invention to provide an outer conductor contact element (8) for a plug connector arrangement (1), comprising at least one fixing stop (15) which, when the outer conductor contact element (8) is in an assembled state on a support sleeve (11), is able to engage behind a cable-side end face (12) of the support sleeve (11) and along a longitudinal axis (L) of the plug connector arrangement (1), said cable-side end face being remote from a front, free end of the outer conductor contact element (8); and the at least one fixing stop (15) is formed in the outer conductor contact element (8) by a male connector-side edge of a material cut-out (17) provided in the outer conductor contact element (8); and the male connector-side edge is proximate to the front, free end of the outer conductor contact element (8).

It is a further object of the present invention to provide an outer conductor contact element (8) wherein the material cut-out (17) is formed in the outer conductor contact element (8) as an in-part annular circumferential slit.

It is a further object of the present invention to provide an outer conductor contact element (8) wherein the material cut-out (17) is provided in the outer conductor contact element (8) in such a manner that the outer conductor contact element (8) forms a tab (18) and the tab is connected on one side, and wherein a free, male connector-side edge of the tab (18) forms the at least one fixing stop (15).

It is a further object of the present invention to provide an outer conductor contact element (8) wherein the outer conductor contact element (8) is reshaped adjacent to the male connector-side edge of the material cut-out (17) and in the direction of the longitudinal axis (L).

It is a further object of the present invention to provide a plug connector arrangement (1), comprising: an electrical cable (2) having an outer conductor; a support sleeve (11) that is fastened to the outer conductor (5) of the electrical cable (2) and the support sleeve (11) has a cable-side end face (12); and an outer conductor contact element (8) comprising at least one fixing stop (15) which, when the outer conductor contact element (8) is in an assembled state on the support sleeve (11), is able to engage behind the cable-side end face (12) of the support sleeve (11) and along a longitudinal axis (L) of the plug connector arrangement (1), the cable-side end face being remote from a front, free end of the outer conductor contact element (8); and the at least one fixing stop (15) is formed in the outer conductor contact element (8) by a male connector-side edge of a material cut-out (17) provided in the outer conductor contact element (8), and the said male connector-side edge is proximate to the front, free end of the outer conductor contact element (8); and the outer conductor contact element is assembled on the support sleeve (11).

It is a further object of the present invention to provide a plug connector arrangement (1) wherein the outer conductor (5) of the electrical cable (2) is folded back, at least in sections, over the support sleeve (11).

It is a further object of the present invention to provide a plug connector arrangement (1) wherein the outer conductor (5) of the electrical cable (2) is folded back over the support sleeve (11) in such a manner that the front, free end of the outer conductor (5) protrudes beyond a cable-side edge of the support sleeve (11).

It is a further object of the present invention to provide a plug connector arrangement (1) wherein the outer conductor contact element (8) is pressed, preferably crimped, onto the support sleeve (11).

It is a further object of the present invention to provide a plug connector arrangement (1) and further comprising an inner conductor contact element (14) that is fastened to an inner conductor (7) of the electrical cable (2); and wherein the inner conductor contact element (14) extends at least in sections along the longitudinal axis (L) through the outer conductor contact element (8).

It is a further object of the present invention to provide an assembly method for a plug connector arrangement (1), comprising the steps; providing an electrical cable (2); providing a support sleeve (11) that has a cable-side end face (12); providing an outer conductor contact element (8) that has a longitudinal axis (L), a front, free end, and a fixing stop (15), and wherein the fixing stop (15) is formed in the outer conductor contact element (8) by a material cut-out (17) provided in the outer conductor contact element (8), and a male connector-side edge of the material cut-out (17) is reshaped in the direction of the longitudinal axis (L) of the plug connector arrangement (1), and the male connector-side edge is proximate to the front, free end of the outer conductor contact element (8); fastening the support sleeve (11) on the electrical cable (2); and assembling the outer conductor contact element (8) on the support sleeve (11) that is fastened on the electrical cable (2) so that the fixing stop (15) engages behind the cable-side end face of the support sleeve (11) and is remote from the front, free end of the outer conductor contact element (8) and along the longitudinal axis (L).

It is a further object of the present invention to provide an assembly method wherein the outer conductor contact element (8) is produced by a stamping-bending process.

It is a further object of the present invention to provide an assembly method wherein the material cut-out (17) is provided in the outer conductor contact element (8) prior to the outer conductor contact element (8) being assembled on the support sleeve (11); and the material cut-out is provided in the outer conductor contact element (8) during the stamping-bending process.

It is a further object of the present invention to provide an outer conductor contact element (8) for a plug connector arrangement (1) wherein the fixing stop is formed from a separate stop element (20) fastened to an inner wall (19) of the outer conductor contact element (8).

It is a further object of the present invention to provide an outer conductor contact element (8) for a plug connector arrangement (1) wherein the fixing stop is formed from a stamped shaping (21) provided in the outer conductor contact element (8) when the outer conductor contact element (8) is in the unassembled state.

It is a further object of the present invention to provide an outer conductor contact element (8) wherein the separate stop element (20) is a sheet metal element or a wire part.

It is a further object of the present invention to provide an outer conductor contact element (8) wherein the stamped shaping (21) that is provided in the outer conductor contact element (8) is formed as an in-part annular connecting piece that extends, starting from an inner wall (19) of the outer conductor contact element (8), in the direction of the longitudinal axis (L).

It is a further object of the present invention to provide an assembly method for a plug connector arrangement (1) wherein the fixing stop (15) is formed in the outer conductor contact element (8) by fastening a separate stop element (20) to an inner wall (19) of the outer conductor contact element (8).

It is a still further object of the present invention to provide an assembly method for a plug connector arrangement (1) wherein the fixing stop (15) is formed in the outer conductor contact element (8) by a stamped shaping (21) that is provided in the outer conductor contact element (8) when the outer conductor contact element (8) is in the unassembled state.

It is an even still further object of the present invention to provide an assembly method wherein the separate stop element (20) is fastened to the inner wall (19) of the outer conductor contact element (8) by means of a clinching process.

In compliance with the statute, the present invention has been described in language more or less specific, as to structural and methodical features. It is to be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalence.

The invention claimed is:

1. An outer conductor contact element (8) for a plug connector arrangement (1), comprising:

at least one fixing stop (15) which, when the outer conductor contact element (8) is in an assembled state on a support sleeve (11), is able to engage behind a cable-side end face (12) of the support sleeve (11) and along a longitudinal axis (L) of the plug connector arrangement (1), said cable-side end face being remote from a front, free end of the outer conductor contact element (8); and the at least one fixing stop (15) is formed in the outer conductor contact element (8) by a male connector-side edge of a material cut-out (17) provided in the outer conductor contact element (8); and the male connector-side edge is proximate to the front, free end of the outer conductor contact element (8); and wherein the material cut-out (17) defined in the outer conductor contact element (8), and forming the at least one fixing stop (15) is a through cut-out extending from an exterior surface of the outer conductor contact element (8) entirely through to an interior surface of the outer conductor contact element (8).

2. The outer conductor contact element (8) as claimed in claim 1 and wherein the material cut-out (17) is formed in the outer conductor contact element (8) as an in-part annular circumferential slit.

3. The outer conductor contact element (8) as claimed in claim 1 and wherein the material cut-out (17) is provided in the outer conductor contact element (8) in such a manner that the outer conductor contact element (8) forms a tab (18) and the tab is connected on one side, and wherein a free, male connector-side edge of the tab (18) forms the at least one fixing stop (15).

4. The outer conductor contact element (8) as claimed in claim 1 and wherein the outer conductor contact element (8) is reshaped adjacent to the male connector-side edge of the material cut-out (17) and in the direction of the longitudinal axis (L).

5. A plug connector arrangement (1), comprising:

an electrical cable (2) having an outer conductor;

a support sleeve (11) that is fastened to the outer conductor (5) of the electrical cable (2) and the support sleeve (11) has a cable-side end face (12); and an outer conductor contact element (8) comprising at least one fixing stop (15) which, when the outer conductor contact element (8) is in an assembled state on the support sleeve (11), is able to engage behind the cable-side end face (12) of the support sleeve (11) and along a longitudinal axis (L) of the plug connector arrangement (1), the cable-side end face being remote from a front, free end of the outer conductor contact element (8); and the at least one fixing stop (15) is formed in the outer conductor contact element (8) by a male connector-side edge of a material cut-out (17), and the material cut-out (17) is a through cut-out extending from an exterior surface of the outer conductor contact element (8) to an interior surface of the outer conductor contact element (8), and the said male connector-side edge is proximate to the front, free end of the outer conductor contact element (8); and the outer conductor contact element is assembled on the support sleeve (11).

6. The plug connector arrangement (1) as claimed in claim 5, and wherein the outer conductor (5) of the electrical cable (2) is folded back, at least in sections, over the support sleeve (11).

7. The plug connector arrangement (1) as claimed in claim 6, and wherein the outer conductor (5) of the electrical cable (2) is folded back over the support sleeve (11) in such a manner that the front, free end of the outer conductor (5) protrudes beyond a cable-side edge of the support sleeve (11).

8. The plug connector arrangement (1) as claimed in claim 5, and wherein the outer conductor contact element (8) is pressed, preferably crimped, onto the support sleeve (11).

9. The plug connector arrangement (1) as claimed in claim 5, and further comprising:

an inner conductor contact element (14) that is fastened to an inner conductor (7) of the electrical cable (2); and wherein the inner conductor contact element (14) extends at least in sections along the longitudinal axis (L) through the outer conductor contact element (8).

10. An assembly method for a plug connector arrangement (1), comprising the steps:

providing an electrical cable (2);

providing a support sleeve (11) that has a cable-side end face (12);

fastening the support sleeve (11) on the electrical cable (2);

providing an outer conductor contact element (8) that has a longitudinal axis (L), a front, free end, and a fixing stop (15), and wherein the fixing stop (15) is formed in the outer conductor contact element (8) by a material cut-out (17) provided in the outer conductor contact element (8), and the material cut-out (17) is a through cut-out extending from an exterior surface of the outer conductor contact element (8) to an interior surface of the outer conductor contact element (8), and a male connector-side edge of the material cut-out (17) is reshaped in the direction of the longitudinal axis (L) of the plug connector arrangement (1), and the male connector-side edge is proximate to the front, free end of the outer conductor contact element (8);

assembling the outer conductor contact element (8) on the support sleeve (11) that is fastened on the electrical cable (2) so that the fixing stop (15) engages behind the cable-side end face of the support sleeve (11) and is remote from the front, free end of the outer conductor contact element (8) and along the longitudinal axis (L).

11. The assembly method as claimed in claim 10 and wherein the outer conductor contact element (8) is produced by a stamping-bending process.

12. The assembly method as claimed in claim 10 and wherein the material cut-out (17) is provided in the outer conductor contact element (8) prior to the outer conductor contact element (8) being assembled on the support sleeve (11); and the material cut-out is provided in the outer conductor contact element (8) during a stamping-bending process.

13. The assembly method for a plug connector arrangement (1) as claimed in claim 10 and wherein the fixing stop (15) is formed in the outer conductor contact element (8) by fastening a separate stop element (20) to an inner wall (19) of the outer conductor contact element (8).

14. The assembly method as claimed in claim 13 and wherein the separate stop element (20) is fastened to the inner wall (19) of the outer conductor contact element (8) by means of a clinching process.

15. The assembly method for a plug connector arrangement (1) as claimed in claim 10 and wherein the fixing stop (15) is formed in the outer conductor contact element (8) by a stamped shaping (21) that is provided in the outer conductor contact element (8) when the outer conductor contact element (8) is in the unassembled state.

16. An outer conductor contact element (8) for a plug connector arrangement (1), comprising:

at least one fixing stop (15) which, when the outer conductor contact element (8) is in an assembled state on a support sleeve (11), is able to engage behind a cable-side end face (12) of the support sleeve (11) and along a longitudinal axis (L) of the plug connector arrangement (1), said cable-side end face being remote from a front, free end of the outer conductor contact element (8); and the at least one fixing stop (15) is formed in the outer conductor contact element (8) from a separate stop element (20) fastened to an inner wall (19) of the outer conductor contact element (8).

17. The outer conductor contact element (8) as claimed in claim 16 and wherein the separate stop element (20) is a sheet metal element or a wire part.

18. An outer conductor contact element (8) for a plug connector arrangement (1), comprising:

at least one fixing stop (15) which, when the outer conductor contact element (8) is in an assembled state on a support sleeve (11), is able to engage behind a cable-side end face (12) of the support sleeve (11) and along a longitudinal axis (L) of the plug connector arrangement (1), said cable-side end face being remote from a front, free end of the outer conductor contact element (8); and the at least one fixing stop (15) is formed in the outer conductor contact element (8) from a stamped shaping (21) provided in the outer conductor contact element (8) when the outer conductor contact element (8) is in the unassembled state; and wherein the stamped shaping (21) forming the at least one fixing stop (15) extends radially inwardly from an interior surface of the outer conductor contact element (8) and toward the longitudinal axis (L) of the plug connector arrangement (1).

19. The outer conductor contact element (8) as claimed in claim 18 and wherein the stamped shaping (21) that is provided in the outer conductor contact element (8) is formed as an in-part annular connecting piece that extends, starting from an inner wall (19) of the outer conductor contact element (8), in the direction of the longitudinal axis (L).

* * * * *